US008875845B2

(12) United States Patent
Nygren

(10) Patent No.: US 8,875,845 B2
(45) Date of Patent: Nov. 4, 2014

(54) SAFETY ARRANGEMENT FOR A LIFT CAR IN A LIFT

(75) Inventor: Gunnar Nygren, Burea (SE)
(73) Assignee: Alimak AB, Skelleftea (SE)

( * ) Notice: Subject to any disclaimer, the term of this patent is extended or adjusted under 35 U.S.C. 154(b) by 1303 days.

(21) Appl. No.: 12/083,602
(22) PCT Filed: Oct. 5, 2006
(86) PCT No.: PCT/SE2006/001130
§ 371 (c)(1), (2), (4) Date: Apr. 15, 2008
(87) PCT Pub. No.: WO2007/046742
PCT Pub. Date: Apr. 26, 2007
(65) Prior Publication Data
US 2009/0159372 A1 Jun. 25, 2009
(30) Foreign Application Priority Data
Oct. 21, 2005 (SE) ..... 0502347
(51) Int. Cl.
*B66B 5/26* (2006.01)
*B66B 11/02* (2006.01)
*B66B 17/34* (2006.01)
*B66B 1/06* (2006.01)
*B66B 5/00* (2006.01)
(52) U.S. Cl.
CPC ..... *B66B 5/26* (2013.01); *B66B 5/0062* (2013.01); *B66B 17/34* (2013.01)
USPC ..... 187/299; 187/352; 187/298; 187/378; 187/401
(58) Field of Classification Search
CPC .... B66B 5/005; B66B 5/0075; B66B 5/0056; B66B 5/0043; B66B 5/0062; B66B 5/26; B66B 17/34
USPC ..... 187/270, 306, 352, 362, 378, 276, 277, 187/298, 299, 379, 314, 317, 401
IPC ..... B66B 5/00, 5/16, 5/26, 9/02, 9/16, B66B 1/06
See application file for complete search history.

(56) References Cited

U.S. PATENT DOCUMENTS 230,006 A * 7/1880 Hall ..... 187/372
281,016 A * 7/1883 Canfield ..... 187/352
(Continued)

FOREIGN PATENT DOCUMENTS

EP 870722 A1 * 10/1998 ..... B66B 11/02
EP 1050505 A1 * 11/2000 ..... B66B 11/02
(Continued)

OTHER PUBLICATIONS

EPO Machine Translation, Description EP1213249, p. 1-8.*
(Continued)

*Primary Examiner* — Michael Mansen
*Assistant Examiner* — Stefan Kruer
(74) *Attorney, Agent, or Firm* — Nixon & Vanderhye P.C.

(57) ABSTRACT

A lift car securing arrangement includes a restraining arrangement having a restraint that is supported by the lift car arranged such that it can be placed into and removed from restraining interaction with an extended stationary interaction element arranged to extend along the vertical pathway of the lift car, and which restraint when placed into restraining interaction locks the lift car to the stationary interaction element, a power-interruption device that can be placed into and removed from a power-interrupting position whereby the power to a driving motor unit that is part of the lift is interrupted when the power-interruption device is placed arranged in its power-interrupting position, in which the power-interruption device is so arranged at the restraining arrangement that the said power-interruption device is located in its power-interrupting position when the restraint has been set into restraining interaction with the extended stationary interaction element.

10 Claims, 4 Drawing Sheets

(56) References Cited

U.S. PATENT DOCUMENTS

Figure 1:
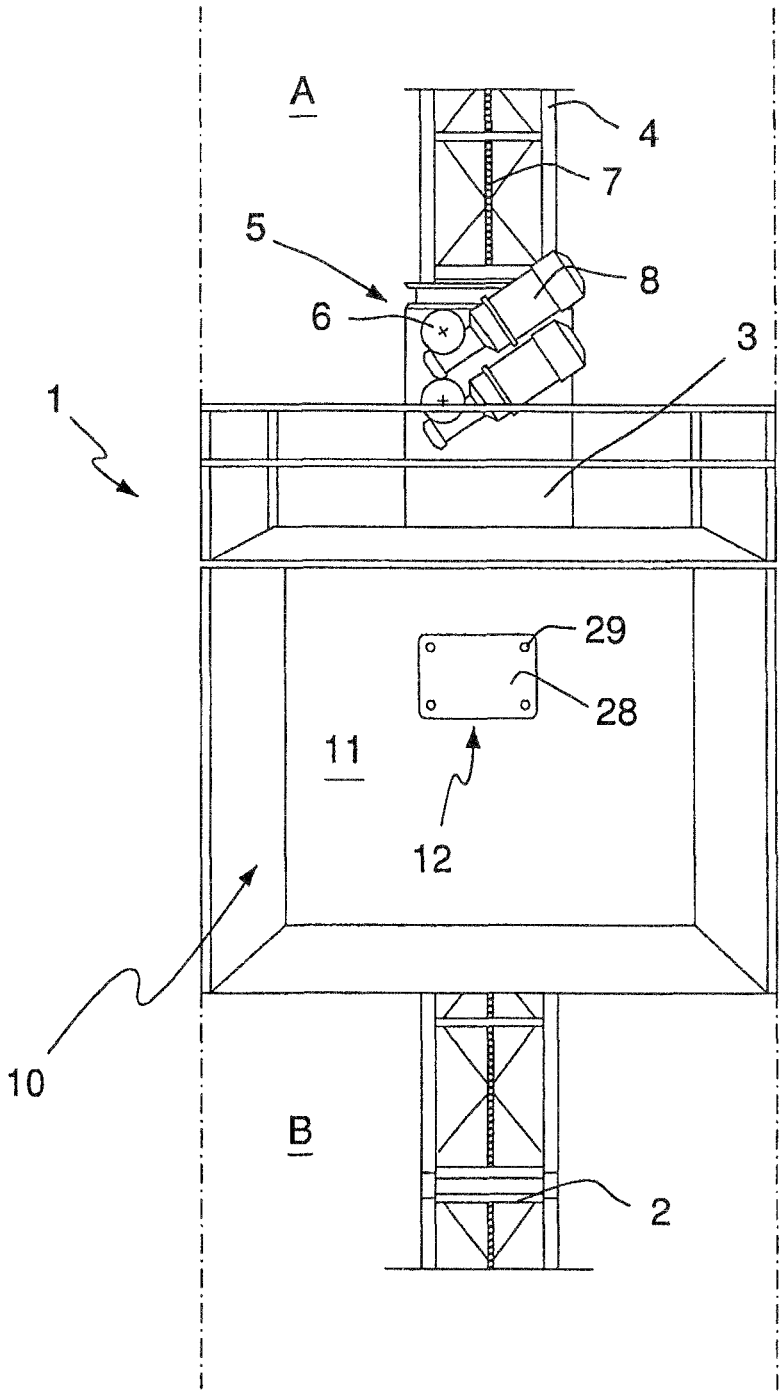

| | | | | | |
|---|---|---|---|---|---|
| 595,786 | A * | 12/1897 | Rogers | 187/362 |
| 1,252,737 | A * | 1/1918 | Tanner | 187/362 |
| 1,874,044 | A * | 8/1932 | James | 187/375 |
| 2,496,714 | A * | 2/1950 | Haines | 16/441 |
| 3,415,343 | A * | 12/1968 | Svensson | 187/270 |
| 3,924,710 | A * | 12/1975 | Shohet | 187/270 |
| 4,516,663 | A * | 5/1985 | D'Alessio et al. | 187/270 |
| 5,511,633 | A * | 4/1996 | Aker | 187/263 |
| 5,613,576 | A * | 3/1997 | Lamb | 187/355 |
| 5,721,403 | A * | 2/1998 | Hoppie et al. | 187/391 |
| 5,773,771 | A * | 6/1998 | Chatham | 187/282 |
| 5,806,633 | A | 9/1998 | Macuga | |
| 5,971,109 | A * | 10/1999 | Aulanko et al. | 187/263 |
| 6,032,763 | A | 3/2000 | Richter et al. | |
| 6,302,240 | B1 * | 10/2001 | Shih | 187/414 |
| 6,494,296 | B2 * | 12/2002 | Lindegger et al. | 187/393 |
| 6,736,242 | B2 * | 5/2004 | Nygren | 187/357 |
| 6,739,431 | B1 * | 5/2004 | Wang | 187/306 |
| 6,739,432 | B2 * | 5/2004 | Elsener | 187/401 |
| 6,892,862 | B2 * | 5/2005 | Helmle | 187/306 |
| 7,556,126 | B2 * | 7/2009 | Wang | 187/314 |
| 2003/0010576 | A1 * | 1/2003 | Malone, Jr. | 187/390 |
| 2003/0015378 | A1 * | 1/2003 | Elsener | 187/336 |
| 2005/0092555 | A1 * | 5/2005 | Lauch | 187/349 |

FOREIGN PATENT DOCUMENTS

| | | | | |
|---|---|---|---|---|
| EP | 1174381 | A1 * | 1/2002 | B66B 5/02 |
| EP | 1 213 249 | | 6/2002 | |
| EP | 1 213 249 | A1 | 6/2002 | |
| EP | 1319626 | A1 * | 6/2003 | B66B 5/00 |
| EP | 1 437 320 | | 7/2004 | |
| EP | 1 437 320 | A1 | 7/2004 | |
| EP | 1533265 | A1 * | 5/2005 | B66B 5/00 |
| JP | 7-206301 | | 8/1995 | |
| JP | 2000-203774 | | 7/2000 | |
| WO | WO 99/47447 | | 9/1999 | |
| WO | 02/096791 | | 12/2002 | |
| WO | WO 02/096791 | | 12/2002 | |
| WO | WO 2005032992 | A1 * | 4/2005 | B66B 5/00 |

OTHER PUBLICATIONS

EPO Machine Translation, Description EP1213249, Jun. 2013, p. 1-8.*

International Search Report for PCT/SE2006/001130 mailed Feb. 26, 2007.

International Preliminary Report on Patentability for PCT/SE2006/001130 mailed Jan. 21, 2008.

* cited by examiner

SAFETY ARRANGEMENT FOR A LIFT CAR IN A LIFT

This application is the U.S. national phase of International Application No. PCT/SE2006/001130 filed 5 Oct. 2006 which designated the U.S. and claims priority to Swedish Patent Application No. 0502347-8 filed 21 Oct. 2005, the entire contents of each of which are hereby incorporated by reference.

The present invention concerns an arrangement for securing a lift car that is part of a lift at a predetermined level and for preventing unintentional motion of the car secured in such a manner as described by the introduction to patent claim 1.

In order to allow service or maintenance work to be carried out on, under or above a lift car, it must be possible to lock the lift car in a safe manner at a predetermined level, such that what are known as "safety spaces" can be created both above and below the lift car. In other words, the lift car must be secured in such a manner that it can in no circumstances whatsoever be displaced unintentionally upwards or downwards or risk crushing a person who is located above or below the lift car. Furthermore, the lift car must be secured in such a manner that it will not be possible for an extraneous person to activate and drive the lift car while it is secured and while maintenance is being carried out.

Previously known arrangements for securing lift cars and creating a safety space located below the lift car normally comprise some form of mechanical support against which the lift car, arranged as a cage or platform, rests while the maintenance is being carried out. See, for example, the arrangements described in WO 99/47447 and in U.S. Pat. No. 5,806,633.

An arrangement is known from U.S. Pat. No. 5,773,771 that has a parallel pair of members that limit transport in the form of rods that can be displaced inwards and outwards in directions that are transverse to the direction of vertical transport of the lift car in the shaft. In other words, they can be caused to move from a withdrawn position outwards from two of the sides of the lift car that face each other. When the transport-limiting members are in their extended positions, the lift car is lowered downwards such that the two rods come into contact with complementary supports arranged in the shaft, against which supports the lift car is caused to rest. A defined safety space under the lift car is created in this manner. The arrangement of an electrical control circuit for the said transport-limiting members is also known from the said document, where the circuit allows the lift car to be transported a limited extent upwards in a direction towards an upper safety space when the support members are located in their extended positions.

A common disadvantage for the prior art technology is that service and maintenance work can take place only at predetermined locations along the vertical pathway of the lift car. In other words, such work can take place only at those locations at which supports or similar support arrangements for the support of the lift car have been arranged. A consequence of this is that the possibilities of being able to carry out such service and maintenance work at a freely chosen location along the pathway of the lift are limited. Neither does the prior art technology make it possible to arrange safety spaces of the type referred to here above and below the lift car.

The aim of the present invention thus is to achieve an arrangement that increases the flexibility and makes it possible to stop the lift car immediately from the platform or cage of the lift car at a freely chosen location along the vertical pathway of the lift car, and that essentially prevents unintentional driving of the lift car when it is securely located at a certain level and in this way creates the safety spaces described above.

This aim is achieved according to the present by means of an arrangement that demonstrates the characteristics that are specified in claim 1. Further advantages and characteristics are made clear by the non-independent claims.

Figure 2:
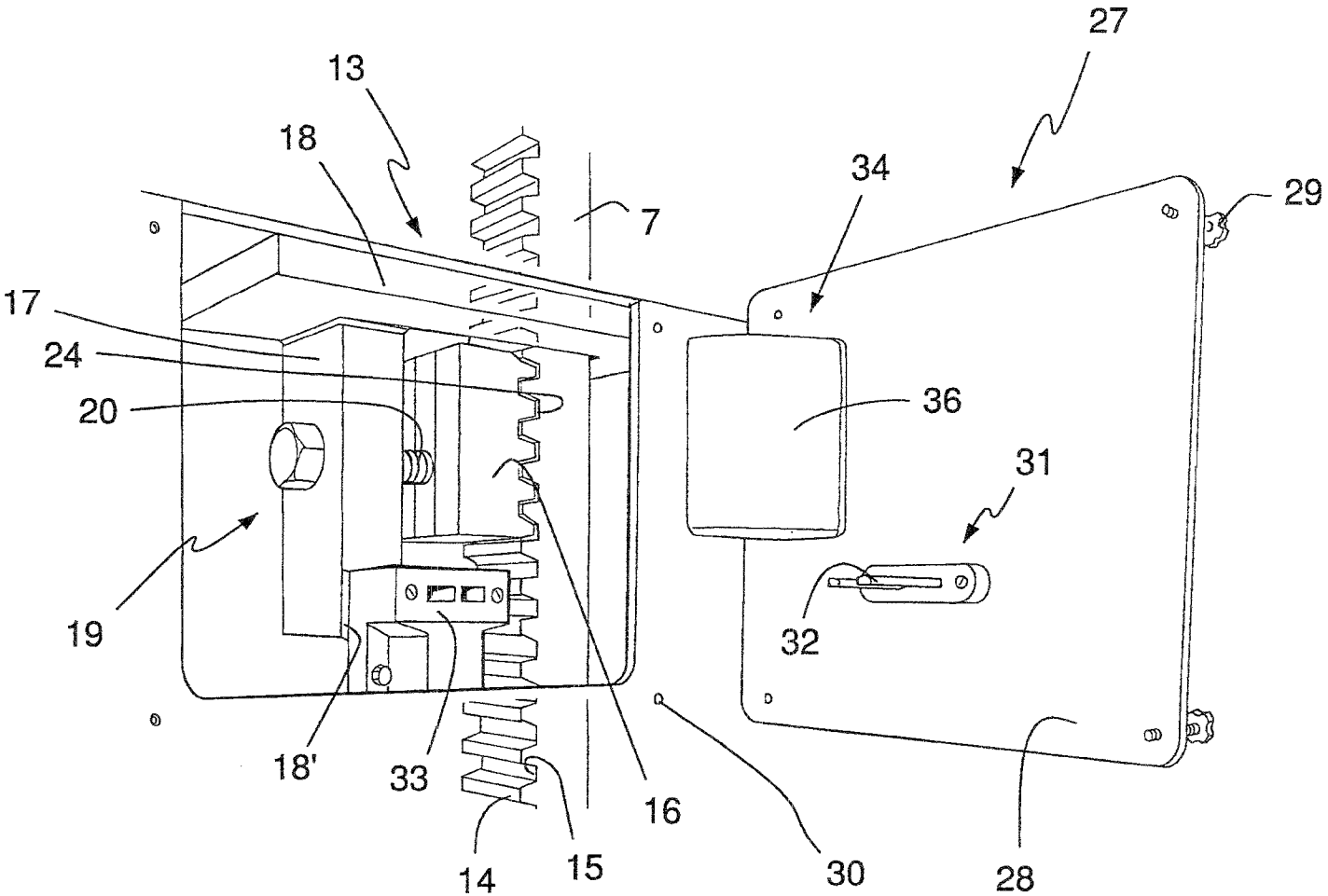
Figure 3:
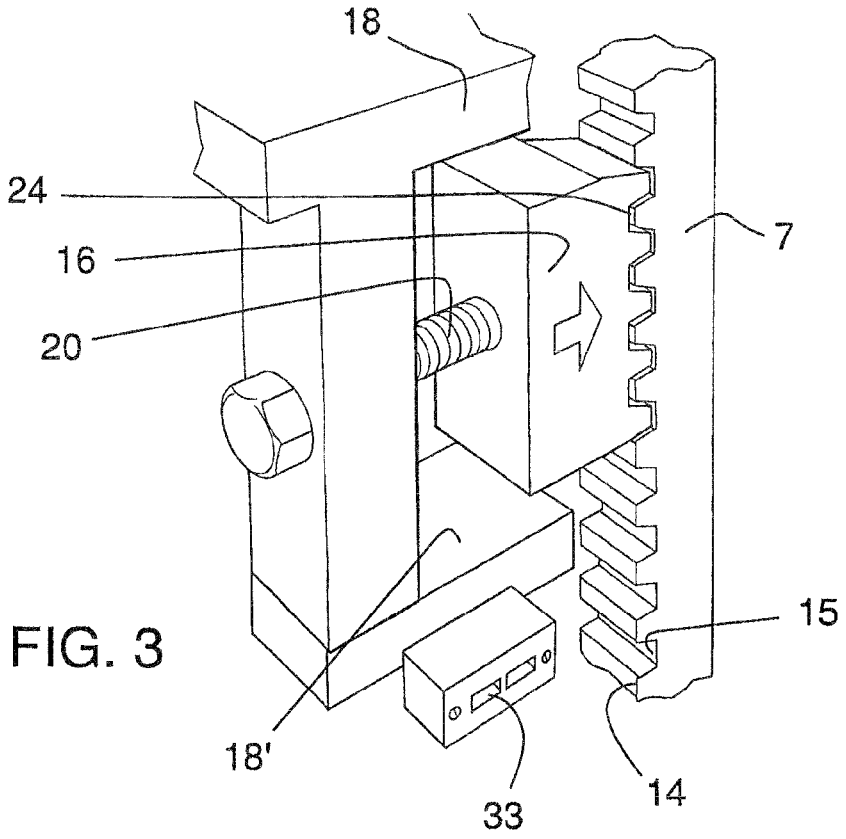
Figure 4:
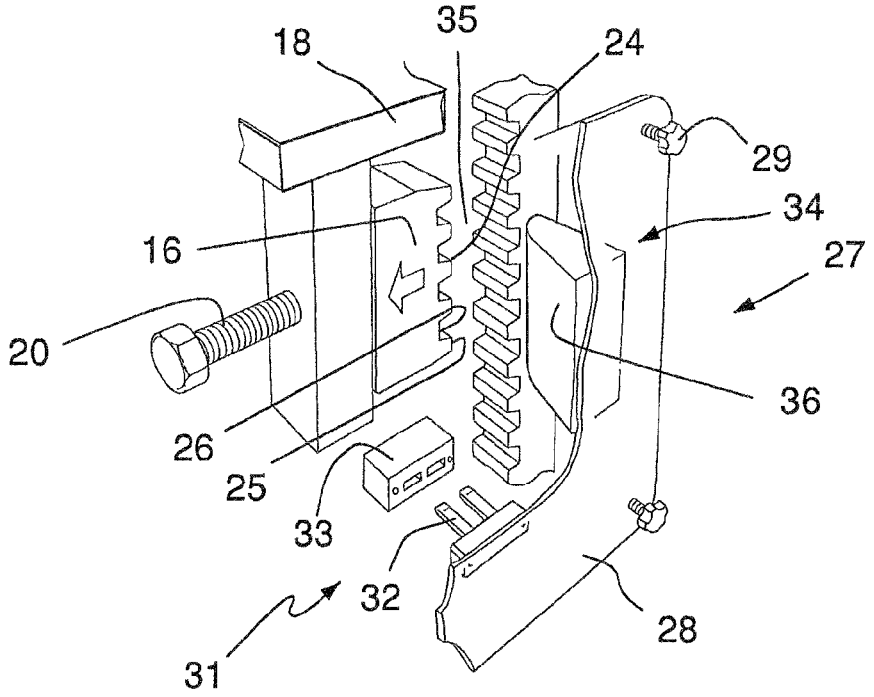
Figure 5:
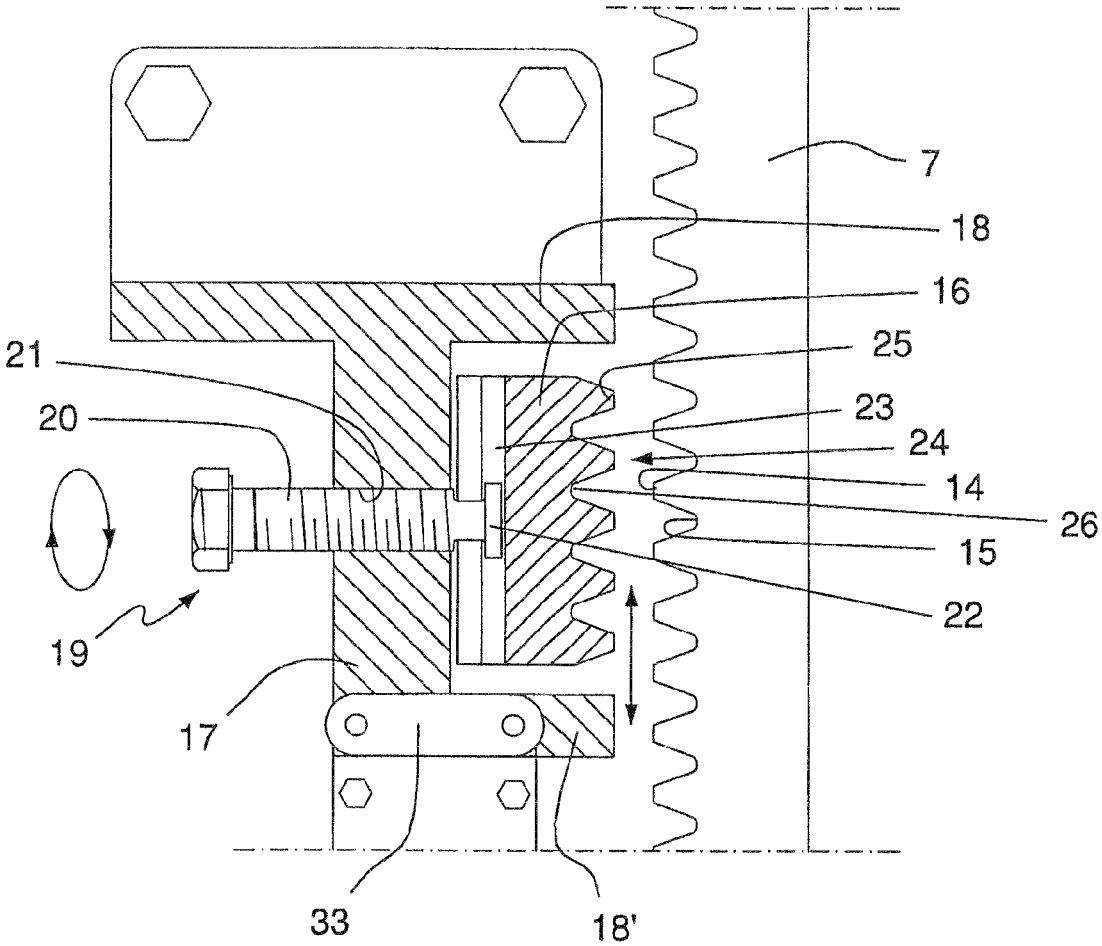
Figure 6:
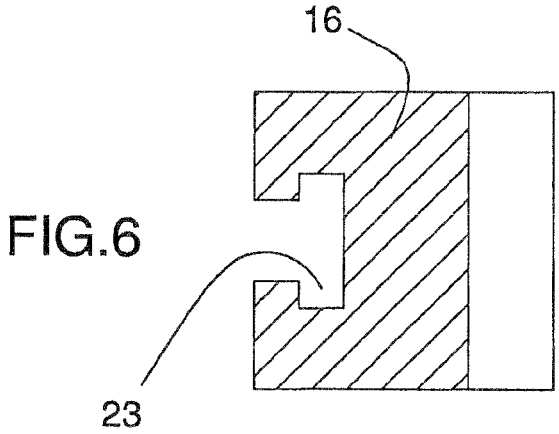

The invention will be described in more detail below with reference to the attached drawings, in which:

FIG. 1 shows a perspective view of a lift car designed to form a part of a cage for the transport of persons or goods and part of a rack and pinion lift system, and, in which lift system an arrangement of the type that the present invention concerns is included, FIG. 2 shows a transparent view of the arrangement according to the invention in which certain parts have been separated from each other, FIG. 3 shows a detailed view of the arrangement according to the invention with surrounding parts partially removed, FIG. 4 shows a detailed view of the arrangement according to the invention with certain parts partially removed, FIG. 5 shows a longitudinal cross-section according to the line V-V in FIG. 4 with certain parts partially removed, and FIG. 6 shows a cross-sectional view according to the line VI-VI in FIG. 4.

FIG. 1 shows an example of a lift system that is common for the transport of both persons and goods, in particular as temporary lifts erected at, for example, building sites.

As FIG. 1 makes clear, a lift car denoted with the reference number 1 is designed as a covered lift cage with wall, floor and roof. The lift car 1 is supported by a trussed mast 2 through a drive frame 3. This drive frame 3 is of a well-known type that is controlled, in a manner that will not be described in more detail here, for vertical transport up and down the mast by means of rollers (not shown in the drawing) that run against longitudinal paths 4 of the mast 2. The lift car 1 is supported by the mast and can be driven along it through driving means generally denoted by 5 that interact with each other, which means in this case are constituted by toothed wheels 6 that are placed in cogged interaction with, and that drive along, a toothed rack 7 that runs along the mast and is attached to it. The toothed wheels 6 are driven in rotation by a gearbox (not shown in the drawings) and an electrically powered motor unit 8 such that the drive frame 3 and thus also the lift car 1 can be transported up and down along the mast 2.

The lift car 1 shown in FIG. 1 has been stopped at a certain level for the execution of service or maintenance work whereby putative safety spaces denoted in the drawing by A and B have been created above and below the lift car 1.

This can be described as previously known technology that in itself does not constitute any part of the invention.

As FIG. 1 makes clear, the walls at the lift car that is arranged as a lift cage limit a transport space generally denoted with reference number 10, whereby, for the purposes of clarity, the lift car depicted in the drawing is shown with the doors, which are normally part of the lift cage, removed. An arrangement, generally denoted by the reference number 12, is arranged on an inner section of wall 11 that separates the transport space 10 from the longitudinal vertical mast 2 along which the lift car 1 runs. This arrangement is designed according to the principles of the present invention and it is available from the transport space 10 of the lift car, and consequently, available for those travelling in the said space.

The present invention is shown in more detail in FIGS. 2-4 and, as these drawings make clear, the arrangement 12 comprises a restraining arrangement that comprises a restraint, generally denoted by the reference number 13, which is arranged for disposition into and; out from retaining interaction with a stationary interaction element 7 that extends along the vertical pathway of motion of the lift car 1, demonstrating a cogged profile with alternating teeth 14 and gaps 15 situated between these teeth.

As the figures make clear, the restraint 13 of the restraining arrangement is supported by the lift car 1 while the interaction element 7 that is, similarly, part of the restraining arrangement is arranged to be stationary and to extend along the pathway of travel of the lift car. This interaction element 7 is constituted in this embodiment by the cogged rack of the particular lift that runs along the mast 2, which cogged rack is used in this type of lift in a known manner for driving the lift car.

As is made most clear by FIGS. 5 and 6, the restraint 13 comprises a push and pull element 16 with the form of a block that is supported by frame 17 arranged in the drive frame 3 of the lift car 1. To be more precise, the push and pull element 16 is located in a manner that allows controlled displacement between two parallel frame sections 18, 18' designed as guides in the frame 17 in such a manner that the push and pull element 16 can be displaced forwards and backwards in a direction that is transverse to the longitudinal direction of the mast 2 through the influence of an adjustment means generally denoted by the reference number 19. The said adjustment means 19 comprises in this case a screw 20 that can be influenced by hand that is mounted to allow turning in a thread 21 that is arranged in a drilled hole that is arranged in the frame 17.

With reference to FIG. 5 the screw 20 is provided at its free end with a thinner section that has the appearance of a groove, which at the terminal part of the end becomes a thickened section 22, relative to the said thinner section, with the form of a ring. This thicker section 22 is in turn taken up in a manner that is controlled by its shape in an undercut groove 23 arranged in the push and pull element 16 that extends in the longitudinal direction of the element 7. It should be realised that this design makes it possible for the screw 20 to be rotated relative to the push and pull element 16, as has been illustrated by the loop-formed line with arrows, and thus that it can be freely screwed into the frame 17 for setting the push and pull element 16 relative to the interaction element 7, while at the same time the push and pull element 16 can be displaced by sliding along the track 23 linearly relative to the free end of the screw 20 within a region that is limited upwards, and downwards by the frame sections 18, 18'. The said vertical linear motion is illustrated in; FIG. 5 by an arrow having two heads.

Furthermore, the push and pull element 16 is provided at its free end with a limited and relatively short cogged section, generally, denoted by the reference number 24, with a toothed profile 14, 15 that corresponds to the cogged teeth of the interaction element 7. As FIG. 5 makes clear, this limited cogged section 24 demonstrates a cogged profile with alternating teeth 25 and gaps 26.

It is possible to vary the length of the screw 20 in the frame 17 with the aid of a common spanner or similar hand tool (not shown in the drawings), and thus also the relative distance from the limited cogged section 24 to the cogged side of the extended interaction element 7 that faces the cogged section can be varied as is shown by the arrow in FIG. 3.

As is made clear by FIGS. 3 and 5, the length of travel of the screw 20 in the frame 17 is adapted such that the free cogged section 24 of the push and pull element 16 can be brought into interaction with the interaction element 7 in its essentially screwed in position. The frame 17 acts in this position as counterpiece whereby the cogged section 24 of the push and pull element 16 can be brought into contact with a certain force with the interaction element 7. Since the push and pull element 16 can move vertically upwards and downwards within a region that is limited by the frame 17 and the relevant sections of frame 18, 18', the push and pull element 16 can be adjusted and directed such that the teeth 25 of the push and pull element 16 always meet and are located aligned with the corresponding gaps 15 of the cogged rack 7 that are located between the teeth 14. This makes it possible to secure the lift car 1 to the extended interaction element 7, even if the lift car has been stopped for service at such a level that the cogged teeth 24 of the push and pull element 16 are not located exactly in line with or directly opposite the corresponding gaps 15 of the interaction element 7.

When placed in interaction with the interaction element 7, the lift car 1 is essentially locked for motion relative to the interaction element 7 and thus also locked for vertical motion upwards and downwards along the pathway of the lift car 1.

FIG. 4 shows the push and pull element 16 of the restraint 13 in its normal position in which it is withdrawn into the frame 17 and does not act as a lock, whereby the lift car 1 can move freely along its vertical pathway.

Through the push and pull element 16 being mounted between the two parallel sections of frame 18, 18', the adjustment means 19 is not subject to any load in itself when the push and pull element 16 is located adjusted in retaining interaction with the longitudinal interaction element 7 of the restraining arrangement. It should also be realised that as a consequence of this all forces that arise during the locking of the lift car to the interaction element 7 that lies along the mast are essentially absorbed by the parallel sections of frame 18, 18' and thus also by the sturdy frame 17.

With renewed reference to FIG. 2, the arrangement comprises an access-limiting means 27 that, when arranged in its access-limiting position, has the task of hiding the arrangement 13, 7 and limiting access to it for those travelling in the transport cage of the lift car 1.

In the embodiment of the invention shown and described here, the access-limiting means 27 comprises a door 28 that can be opened arranged in a section of the wall 11, which door when in its closed position covers or blocks a hole or an opening in the section of wall. The door 28 is mounted, such that it can be removed, in the said section of wall 11 by means of a number of attachment means 29 in the form of a set of knobs provided with screws, which knobs can be loosened by hand and be screwed into threaded holes 30 in the wall 11. Both the restraint 13 that is part of the restraining arrangement and the extended interaction element 7 are thus located behind and can be accessed through the opening arranged in the wall 11. Thus, when the door 28 is in its open position or totally removed from the section of wall 11, it is easy to change the setting of the restraining arrangement 13, 7, while when the door 28 is mounted in its place by means of the attachment means 29 only limited access is available to the restraining arrangement 13, 7 from the cage of the lift car 1. The term "limited" is here used to denote the situation in which the restraining arrangement 13, 7 is not immediately accessible from the lift cage, but is only available for disposition after certain operations or actions have been carried out.

In the case that it should be necessary for reasons of safety, the access-limiting means 27 would be assigned some form of lock (not shown in the drawings) that can be opened with a key or code, which would significantly reduce the risk of unauthorised access to the devices 13, 7 that are parts of the restraining arrangement.

Not only does the restraining arrangement 13, 7 make possible solely mechanical securing of the lift car 1 at a certain level: the present arrangement also offers supplementary safety arrangements with respect to unintentional driving of a lift car that has been secured at a certain level, and in this way the creation of what are known as "safety spaces" A and B.

To be more precise, the present arrangement comprises two principally supplementary arrangements that contribute significantly to the provision of the said supplementary safety.

As a first supplementary arrangement that offers safety, the arrangement comprises a power-interruption device 31. The said power-interruption device 31 can be placed into and removed from a power-interruption; position, and it has the task of interrupting the power to the electrical motor units 8 of the lift car 1 if the access-limiting arrangement 27 is removed from its customary access-limiting position over the restraining arrangement 13, 7. The power-interruption device 31 comprises for this purpose a; contact, divided into two, that consists of a contact of what is known as a "pin" or "blade" type that can be inserted into a holder. As is made most clear by FIG. 2, the one part 32 of the contact having the shape of a pin is arranged on the access-limiting device 27 and is an integral part of this device, while the second part 33 of the contact is attached to the frame 17 such that power to the driving motors 8 is interrupted when the access-limiting device 27 is opened or removed such that the restraining arrangement 13, 7 becomes accessible for disposition.

As a second arrangement that offers security, the device comprises a stop means 34 that prevents the access-limiting device 27 from being arranged in its access-limiting position as long as the limited cogged section 24 of the push and pull element 16 is located set into locking interaction with the cogged teeth 14, 15 of the interaction element 7 that extends along the vertical pathway of the lift car 1. Through the access-limiting device 27 being prevented from being remounted in its access-limiting position, it should be realised that the two contact parts 32, 33 of the power-interruption device 31 will remain separated from each other and thus that the driving motors 8 will remain without power as long as the restraining arrangement 13, 7 is located set in an interacting position. This is the case, in other words, while the cogged section 22 of the push and pull element 16 of the restraint 13 is positioned in active restraining interaction with the interaction element 7.

The supplementary arrangements offering safety specified above will be described in more detail with reference to FIGS. 3-5, and, as is made most clear by FIG. 4, a space denoted by the reference number 35 is limited between the cogged section 22 of the push and pull element 16 and the interaction element 7 when the push and pull element 16 of the restraint 13 is located in its withdrawn, inactive, position in the frame 17

In contrast, when the push and pull element 16 is located in its protruded actively locking position, as is shown in FIG. 3 for a locked lift car 1, the push and pull element 16 forms in interaction with a profiled sheet element 36 that is supported by the access-limiting device 27 the stop means 34 described above. To be more precise, it should be realised that the push and pull element 16, when placed in its protruded locking position, in this manner efficiently blocks the access-limiting device 27 from being remounted in its place in the wall 11 and over the restraining arrangement 13, 7, through interaction or contact between the profiled sheet element 36 and the push and pull element 16. This blockage remains as long as the push and pull element 16 remains positioned in its extended active locking position with the interaction element 7, as shown in FIG. 3.

When the access-limiting device 27 is located in its normal access-limiting position above the restraining arrangement 13, 7, the profiled sheet element 36 of the stop means 34 is taken up into the space 35 between the withdrawn push and pull element 16 of the restraint 13 and the interaction element 7. Close study of FIG. 4 should lead to the realisation that the profiled sheet element 36 in this way efficiently prevents the free cogged section 24 of the push and pull element 16 from coming into contact with the cogged rack 7. This blockage remains as long as the said sheet element 36 is located in the space 35.

The present invention functions in the following manner.

During service or maintenance on or around the lift car 1 at a given vertical level, the screws 29 are initially removed, followed by the access-limiting device 27 that is arranged as a door 28 in the wall section 11. One consequence of this is that the two contacts 32, 33 of the power-interruption device 31 are separated from each other such that power to the two electrical driving motors 8 is interrupted. When the access-limiting device 27 has been removed, that is, when the door 28 has been removed from its position over the opening in the section of wall 11, the stop means 34 in the form of a profiled sheet element 36 is also removed from its inserted position in the space 35 between the cogged section 24 of the withdrawn push and pull element 16 and the interaction element 7 such that the push and pull element 16 of the restraint 13 is freed and can be displaced in a direction forwards towards the said cogged profile of the interaction element of alternating teeth 15 and gaps 15.

With the aid of a spanner (not shown in the drawings), the screw 20 is manually moved such that the push and pull element 16 of the restraint 13 moves forwards and its free cogged end section 24 comes into contact with a certain force with the cogged profile 14, 15 of the interaction element 7. In the case in which the cogged teeth 24 of the push and pull element 16 are not aligned with the corresponding gaps 15 of the interaction element 7, the push and pull element 16 is adjusted in the height or vertical direction before it is placed in contact with the interaction element 7.

The lift car 1 is now located in locked interaction with the interaction element 7 and is thus secure from motion relative to the mast 2, and thus in a vertical direction, in such a manner that the safety spaces A and B specified above are created above and below the lift car 1.

The present invention is not limited to that which has been described above and what has been illustrated in the drawings. It can be changed and modified in a number of different ways for the innovative concept specified in the attached patent claims. Thus it is conceivable within the said framework to use a number of different types of interacting locks that offer a locking action between the lift car and the extended interaction element. It would thus lie within the scope of this to use means that offer a locking effect between the lift car and the extended interaction element through-wedging, action and interaction in side regions of some part of the lift car and the extended element. It should also be understood that the extended stationary interaction element does not need to be continuous: it can consist of a series of elements arranged in a row after, each other that together form an extended unified element.

The invention claimed is:

1. An arrangement for securing a vertically movable lift car at a predetermined level in an electrically driven lift, the lift car including a wall at least partially delimitting a transport space to accommodate passengers, the wall including an opening therein, the arrangement comprising:

a restraining arrangement supported by the lift car, the restraining arrangement having a restraint that includes a first mode and a second mode, the restraint in the first mode being arranged in a restraining interaction position with a cogged rack to thereby lock the lift car to the cogged rack, the restraint in the second mode being removed from the restraining interaction position with the cogged rack, the cogged rack being arranged to extend along a vertical pathway of the lift car, the restraint arranged to be accessible through an opening in a wall of the lift car;

a power-interruption device supported by the lift car, the power-interruption device including a first mode and a second mode, the power interruption device in the first mode being arranged in a position that breaks a circuit that powers a motor of the lift car and the power-interruption device in the second mode being arranged to allow power to be provided to the circuit;

an access-limiting device configured to be placed in an access-limiting position in which access to the restraint from a transport space of the lift car is limited, the access-limiting device including a cover member configured to removably cover the opening in the wall of the lift car to limit access to the restraint; and a stop protruding from the cover member, the stop being configured to prevent the access-limiting device from being placed in the access-limiting position when the restraint is in the first mode, wherein the power-interruption device is attached to the cover member such that the power-interruption device is arranged in the first mode that breaks the circuit that powers the motor when the access-limiting device is removed from the access-limiting position.

2. The arrangement according to claim 1, wherein the restraint comprises a push and pull element which at one end faces the cogged rack and includes a section with teeth that correspond to teeth and gaps of the cogged rack, in which the push and pull element can be positioned from a withdrawn resting position corresponding to the second mode into a protruding active interactive position with the cogged rack corresponding to the first mode for securing the lift car to the cogged rack.

3. The arrangement according to claim 2, wherein the push and pull element is supported in a manner that allows displacement in a frame arranged on the lift car and can be set via an adjustment device that is configured to act between the push and pull element and the frame in a direction transverse to the longitudinal direction of the cogged rack.

4. The arrangement according to claim 1, wherein the restraint is so located on the lift car that the restraint is accessible for resetting between the first mode in restraining interaction with the cogged rack and the second mode.

5. The arrangement according to claim 4, wherein the cover member is attached through fixing means to the wall, and wherein the restraint is concealed from the cage or platform of the lift car when the cover member covers the opening.

6. The arrangement according to claim 5, wherein the fixing means comprises a set of knobs provided with screws that can be removed by hand and that can be screwed into threaded holes in an inner section of the wall.

7. The arrangement according to claim 5, wherein the power-interruption device comprises a contact in two parts, wherein the contact is a pin or a blade contact, in which one contact part is arranged at the cover member and the second contact part is supported by the lift car in the region of the restraining arrangement.

8. A lift car, comprising:

a longitudinal vertical mast; and the arrangement of claim 1, wherein the lift car is a rack and pinion lift car where the cogged rack extends along the longitudinal vertical mast along which the lift car is driven by interaction between the cogged rack and a toothed wheel that is driven in a manner that allows rotation by the motor.

9. The lift car according to claim 8, further comprising the wall of the lift car, the wall separating a cage or platform of the lift car from the mast along which the lift car runs, in which the restraint is positioned between the wall and the cogged rack and is accessible for setting into and out from the restraining interaction position through the opening in the wall.

10. The arrangement according to claim 1, wherein when the cover member covers the opening, the stop is arranged to prevent the restraint from being set in the first mode.

* * * * *